United States Patent [19]

Watanabe

[11] Patent Number: 4,685,392

[45] Date of Patent: Aug. 11, 1987

[54] AUTOMATIC DEVICE FOR PREPARING PAPER ROLLS FOR WEB PASTING

[75] Inventor: Takemi Watanabe, Toyonaka, Japan

[73] Assignee: Kabushiki Kaisha Kaneda Kikai Seisakusho, Osaka, Japan

[21] Appl. No.: 877,929

[22] Filed: Jun. 24, 1986

[51] Int. Cl.[4] ..... B41F 13/56; B65H 19/22

[52] U.S. Cl. ..... 101/226; 226/91; 242/58.5; 156/505

[58] Field of Search ..... 101/226–227, 101/224; 226/11, 91, 92; 242/56 R, 58.1–58.5, 59; 156/502, 504, 505, 506

[56] References Cited

U.S. PATENT DOCUMENTS

| | | | |
|---|---|---|---|
| 3,780,960 | 12/1973 | Tokuno et al. | 242/58.1 |
| 3,843,483 | 10/1974 | Sendor et al. | 101/226 X |
| 3,863,854 | 2/1975 | Tokuno | 242/58.2 |
| 3,891,158 | 6/1975 | Shearon | 156/504 X |
| 4,094,727 | 6/1978 | Collins | 156/505 |
| 4,290,834 | 9/1981 | Buetiel | 156/505 X |
| 4,315,794 | 2/1982 | Palmieri | 156/504 |
| 4,526,638 | 7/1985 | Clements | 156/505 X |
| 4,543,152 | 9/1985 | Nozaka | 156/505 X |
| 4,564,413 | 1/1986 | Murakami | 156/504 |
| 4,599,130 | 7/1986 | Woodley | 242/58.1 X |

*Primary Examiner*—E. H. Eickholt

*Attorney, Agent, or Firm*—Griffin, Branigan, & Butler

[57] ABSTRACT

A paper roll stand holds a paper roll in such a manner as to allow it to rotate in two opposite directions so as to temporarily locate a leading web end on a table board. An arm assembly positioned above the table board is movable in the lengthwise and lateral directions. The arm assembly includes a suction cup device for lifting up the outermost web of the paper roll, a cutter device for cutting the paper web, and a tape-attaching device for adhesively attaching web pasting adhesive tapes to the web's leading end. A device for adhesively attaching a head of a web end-fastening strip to an inner side of the web's leading end is located below the web. A paper roll-pressing device for adhesively fastening a tail of the web end-fastening strip to the outer surface of the roll is also included. A new paper roll prepared for web pasting according to the present invention is brought to the paper roll stand of a printing unit and rotatably held thereon. This new, prepared, roll is rotated at a set rate on the reel stand, and, by pressing the end of an old, expiring, web against the leading web end of the new roll, the expiring web is adhesively pasted to the new web leading end.

7 Claims, 21 Drawing Figures

AUTOMATIC DEVICE FOR PREPARING PAPER ROLLS FOR WEB PASTING

BACKGROUND OF THE INVENTION

The present invention relates to a device that, when a paper roll being fed onto a printing machine reaches its end (is expiring), automatically prepares the leading web end of a new roll for automatic web-to-web pasting, or splicing, by means of an adhesive.

As shown in FIG. 11, a printing system for newspapers or the like includes a printing machine C which is generaly fed with a paper web from one of a plurality of paper rolls B rotatively held on a reel stand A. When a paper roll B1 being fed into the printing machine C is expiring, a new paper roll B2 positioned nearest to it, is started rotating by a drive device D and made to rotate at a rate peripherally equal to the rate at which the expiring paper B1 is being fed. A pusher E is then made to press the trailing end of the expiring web from the paper roll B1 against the leading end of the new paper roll B2 so as to paste, or splice, the two webs to each other by means of an adhesive.

Connection of the new paper roll B2 to the expiring roll B1 requires that the leading web end of the new roll be prepared beforehand for this adhesive-based pasting. Conventionally, it has been the practice to prepare new paper rolls for pasting entirely by manual procedure substantially in the manner described below, to make a leading web end assume the form shown in FIG. 12.

(1) In order to remove from the paper roll any loose portion or damaged area that may have been caused thereto in transit, the paper roll is stripped of peripheral layers (three to five layers from the peripheral surface) with a spatula or the like;

(2) the leading web end is cut with scissors or the like into a substantially triangular form to adapt it for the pasting;

(3) the tip of the leading web edge thus formed is fastened to the peripheral surface of the paper roll B by means of an adhesive web edge fastening strip F;

(4) strips of adhesive tape G for adhesion in pasting are adhesively attached to the V-shaped leading web end.

The manual process to carry out all of these steps has been very inefficient and costly as well. Another problem has been an excessive loss of paper incidental to the manual process because the manual removal of peripheral layers is liable to damage inner layers that otherwise are good for use.

SUMMARY OF THE INVENTION

The present invention has been developed with a view to solving the above-mentioned problems that are generally involved in the manual preparation of paper rolls for pasting and purports to accomplish the following objects:

- the first object is to provide a device for preparing leading web ends for splicing paper rolls whereby the required preparation is carried out entirely automatically and with high efficiency and accuracy;
- the second object is to provide a device as described above, whereby the required web preparation is carried out without causing a large loss of news print;
- the third object is to provide a device as described above, which can be installed inside a paper roll storage room in a printing system or in a passageway for conveyance of paper rolls from storage to the printing machine.

To meet each of these objects, there is provided a device embodying the present invention which comprises a paper roll stand to hold a paper roll in such a manner as to allow it to rotate in two opposite directions, a table board on which leading web ends are placed, and an arm assembly positioned above the table board. An arm proper of the arm assembly is capable of being moved lengthwise as well as laterally. A suction cup device attached to the arm assembly is designed to lift up the outermost web of the paper roll while a cutter device attached to the arm assembly cuts the paper web. An adhesive tape-attaching device attached to the arm assembly adhesively attaches web pasting adhesive tapes to the web's leading end. A web edge fastening strip-attaching device adhesively attaches the head of a web end-fastening strip to the inner side of the web's leading end. A paper roll-pressing device adhesively fastens the tail of the fastening strip to the outer surface of the web roll.

The above-mentioned device is designed to operate in the following manner:

(1) a paper roll is rotatably held on the paper roll stand;

(2) the vacuum suction cup is pressed against the leadng web end at a suitable position and lifts up the outermost web layer;

(3) a blade of the cutter device is inserted from a fringe into an opening produced by the lifting of the outermost web layer and is then moved breadthwise to cut the web across;

(4) the paper roll is turned so as to remove the cut-off portion of the web from the machine and to draw the leading web end onto the table assembly;

(5) a blade of the cutter device is applied to the web end and moved in such a manner as to produce a substantially V-shaped incision in the web so that the web edge assumes the shape of an angle of a triangle;

(6) an adhesive tape-attaching device is activated to adhesively attach strips of adhesive tape for web pasting to the outer surface of the V-shaped leading web end;

(7) simultaneously with the above-mentioned process, the web edge fastening strip-attaching device, positioned under the table assembly, is activated to adhesively attach the head of a fastening strip, from under the table assembly, to the inner side of the tip of the V-shaped leading web end; and (8) the paper roll is turned backward to draw back the leading web end from the table assembly so that the cut-off portions adjoining the V-shaped web end are removed and with the web end drawn back on the paper roll the tail of the web edge fastening strip stuck to the web end as described above is adhesivley attached to the peripheral web at a position adjacent to the web end under pressure from a paper roll-pressing device.

In practice, a device embodying the present invention exhibits the following advantages:

(1) the peripheral layers can be removed for a set length from a paper roll and therefore, less printing paper is wasted;

(2) the removal of the peripheral layers from a paper roll can be performed without causing damage to the remaining inner web, and therefore, there occurs no loss of paper that otherwise may possibly be caused at the time of removal of the peripheral layers;

(3) since paper rolls can be automatically prepared for web splicing with accuracy, the device therefore affords economy with respect to cost and assurance against faults with respect to work, as compared to manual preparations;

(4) the integrated web-preparing device can be installed inside a paper-roll storage or at any spot in a passageway for conveyance of paper rolls from a storage rooom to a printing machine according to one's selection;

(5) the attachment of a web edge fastening strip for web end fastening is performed simultaneously with formation of the V-shaped incision and the attachment of adhesive tape for web pasting so that the time needed for paper roll preparation for pasting is greatly shortened; and (6) fully automatic paper roll splicing becomes possible because a protective coating film overlaying adhesive tape for web splicing is removed when the tape is applied to the web end.

BRIEF DESCRIPTION OF THE DRAWINGS

The foregoing and other objects, features and advantages of the invention will be apparent from the following more particular description of a preferred embodiment as illustrated in the accompanying drawings in which reference characters refer to the same parts throughout the various views. The drawings are not necessarily to scale, emphasis instead being placed upon illustrating principles of the invention.

DETAILED DESCRIPTION OF THE INVENTION

Figure 1:
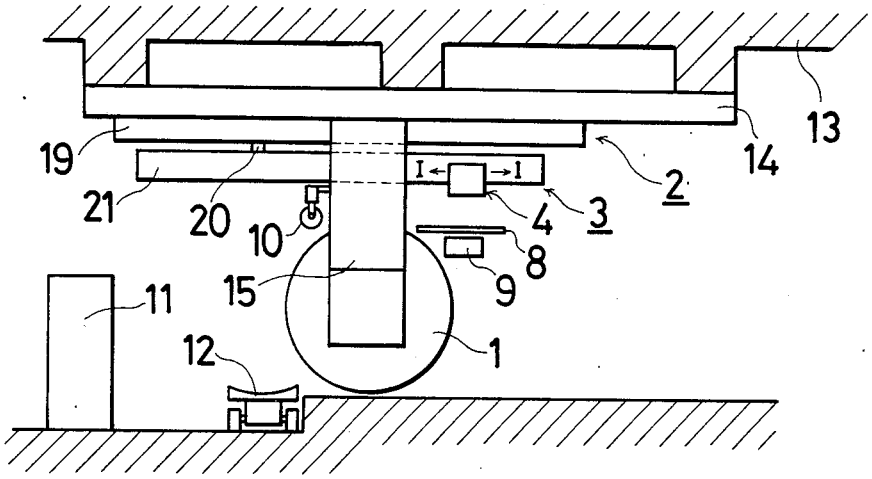
FIG. 1 shows schematically an elevational view of a paper web preparing device of this invention as seem from an axial direction of a paper roll.
Figure 2:
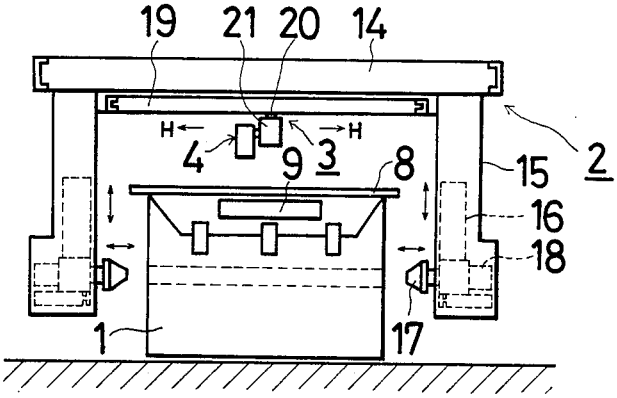
FIG. 2 shows schematically an elevational view of the integrated paper web preparing device of FIG. 1 as seen laterally therefrom.

Referring now to FIG. 1 and FIG. 2, there is shown a device embodying the present invention installed at a spot separate from a related printing machine, FIG. 1 as seen from an axial direction of the paper roll and FIG. 2 as seen laterally therefrom.

Figure 4:
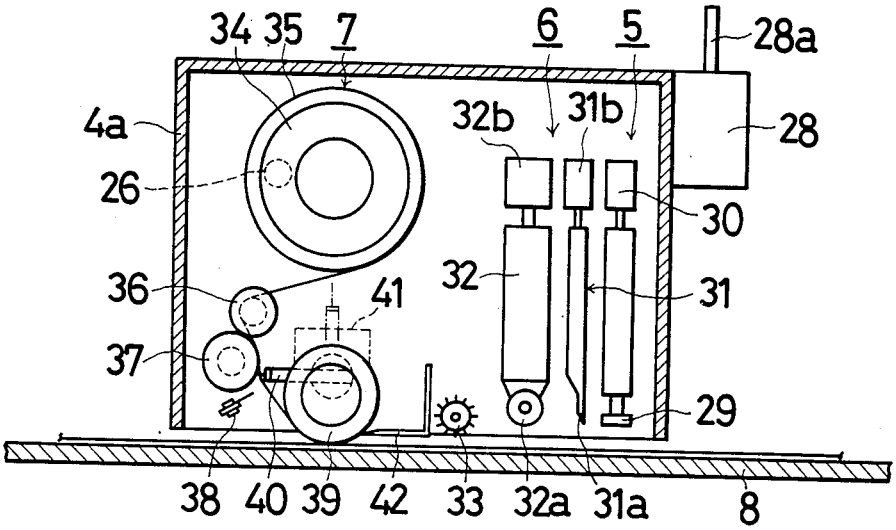
FIG. 4 is a partially-cutaway diagram illustrating in detail the inside of the main preparing device of FIG. 3.

Shown in these drawings are a paper roll 1, a paper roll stand 2, an arm assembly 3, a main preparing device 4, etc. As shown in FIG. 4, the main preparing device 4 comprises a suction cup device 5 for lifting up the peripheral web of a paper roll, a cutter device 6 which cuts the peripheral web breadthwise into a set web-end shape, and an adhesive tape-attaching device 7 which applies strips of adhesive tape for web pasting to the leading web end. A table device 8 is designed to hold the web end when it lands thereon; a web-edge fastening, strip-attaching, device 9 is designed to adhesively attach the head of a fastening strip to the inner side of the leading web end; a paper roll-pressing device 10 is designed to adhesively attach the tail of the fastening strip to the peripheral web at a position adjacent to the leading web end; a control panel is indicated by 11; a paper roll conveyor is indicated by 12; and a ceiling of a building is indicated by 13.

The paper roll stand 2 comprises a horizontal base frame 14 attached to the ceiling 13, a pair of vertical paper roll-holding frames 15 which, suspended from the base frame 14, hold paper rolls in suspension from above between the two holding frames 15, a pair of paper roll-holding members 16 each of which is housed in a paper roll-holing frame 15 and is designed to be moved upward and downward, a pair of rotative axial supports 17 for paper rolls which are capable of being moved in opposite axial directions at the two axial ends of a paper roll, and a pair of electric motors 18, each of which rotates one of the two axial supports 17.

Although the example described herein relating to the present invention employs a three-sided paper roll stand 2 (horizontal frame 14 and roll holding frames 15) which is supported above from a ceiling, a paper roll stand 2 embodying the present invention can also be built on a floor of a building in the manner of erection instead of suspension.

The arm assembly 3 comprises a guide rail 19 which is attached to the base frame 14 and another guide rail 21 which is held at a right angle to and in suspension from the guide rail 19 with a pivotal holding member 20 between the two guide rails, the guide rail 21 being capable of being moved in the lengthwise directions of the guide rail 19, i.e., in the directions of H —H in FIG. 2, as well as being turned horizontally on the pivotal holding member 20. The main preparing device 4 is attached to the guide rail 21 and is capable of being moved in directions perpendicular to the axis of a paper roll, i.e. in the directions of I —I in FIG. 1.

Figure 3:
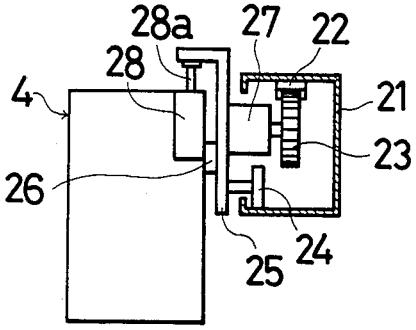
FIG. 3 is a schematic side view of the main preparing device of the FIG. 1 integrated device with its linkage.

Referring to FIG. 3, there is shown the main preparing device 4 in position in its assembly with the adjoining devices, wherein the guide rail 21, which supports the main preparing device 4, has on its top interior wall a stretch of rack 22 into which a pinion 23 is fitted and has on its bottom interior wall a roller 24 which holds a travelling plate 25 and allows it to travel along the guide rail 21. The main preparing device 4 is supported by the travelling plate 25 with a supporting pin 26 which, connecting the two, permits an up-and-down movement of the main preparing device at the forward part. With an electric motor 27 connected with the pinion 23, the main preparing device 4 can be moved along the guide rail 21 by activating the motor 27 to rotate the pinion 23. The main preparing device 4 is equipped with a solenoid 28 having a plunger 28*a* at the forward side, whereby the main preparing device 4 can be moved downward at the forward part on the supporting pin 26 as the plunger 28*a* is pushed outwardly by the solenoid 28.

As shown in FIG. 4, the main preparing device 4 housed in the housing case 4*a* comprises the suction cup device 5 which lifts up the peripheral web of a paper roll, the cutter device 6 which cuts the peripheral web breadthwise into a set web-end shape and the adhesive tape-attaching device 7 which applies strips of adhesive tape for web pasting to the leading web end.

The suction cup device 5, housed in position in the housing case 4*a*, has a vacuum suction cup 29 at one end and a solenoid 30 that moves the suction cup in the vertical directions.

The cutter device 6 for forming the leading web end comprises a cutter element 31 for cutting the peripheral web of a paper roll breadthwise and a cutter element 32 for cutting the web end into substantially an angle of a triangle. Specifically, the cutter element 31 comprises a blade 31*a* that, when the peripheral web is lifted up, is inserted into the opening under the peripheral web and moved thereacross, breadthwise, to cut the peripheral web, and a solenoid 31*b* that moves the blade 31*a* in vertical directions. The cutter element 32 comprises a blade 32*a* for which either a circular blade or a blade with a pointed tip is employed, and a solenoid 32*b* that moves the blade 32*a* in vertical directions.

Whereas the description herein refers to two separate cutters 31 and 32, a cutter device consisting of one single cutter device applicable to both breadthwise cutting and V-shaped cutting may also be used in practicing the present invention.

Figure 5A:
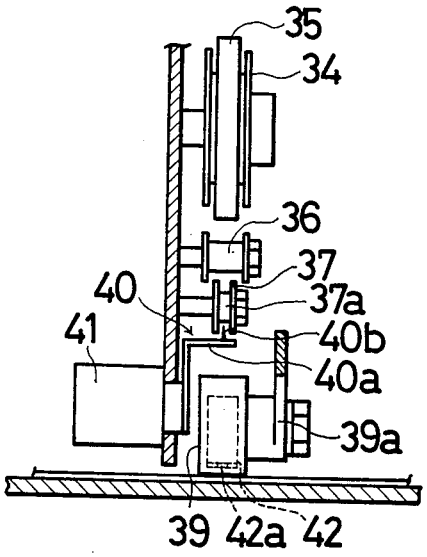
FIG. 5A shows schematically an elevational view of one type of adhesive tape-attaching device for adhesively attaching adhesive tapes for web pasting in the integrated web preparing device of FIG. 1.

The adhesive tape-attaching device 7, as shown in FIG. 4 and FIG. 5A, comprises a reel 34 on which a reel of double side-coated adhesive tape 35 is loaded, a guide roller 36, a V-grooved roll 37, a tape cutter 38, a free pressing roller 39, a rotation supporting pin 40, an electric motor 41 for rotating the supporting pin, a pin remover 42 for removing the pin 40 from the tape 35, and a protective-coating-film remover 33 for removing the protective coating film from the tape.

The double-side-coated adhesive tape 35 consists of a tape coated with an adhesive on both sides and overlaid on the outer side with protective coating film which is removable from the adhesive tape. A reel of this adhesive tape is loaded on a reel 34.

The V-grooved roller 37 has on its peripheral surface a substantially V-shaped groove 37*a* whereon the foremost end of the rotation supporting pin 40 is stuck into the double side-coated adhesive tape 35. The rotation supporting pin 40 consists of an arm 40*a* and a pin point 40*b* and is moved in a circular motion intermittently by an electric motor 41.

The free pressing roller 39 is held on a movable support 39*a* in such a manner as to be vertically movable and is designed to be rolled on and along the table board 8.

The protective-coating film remover 33 is a roller having a plurality of claws peripherally and held in such a manner as to be freely movable vertically. This remover is designed to remove the protective coating film from the strips of double side-coated adhesive tape 35 when the strips 35 have been adhesively attached to a leading web end so that the outer adhesive coating is exposed.

The pin remover 42 consists of a narrow metal strip with a notch 42*a* at one end, through which the pin point 40*b* passes in a circular motion.

The tape cutter 38 is positioned under the V-grooved roller 37 and is designed for its blade to be thrust forward by the action of a cylinder when cuttng.

In practicing the present invention, it is also practical to attach the suction cup device 5, the cutter device 6, and the adhesive tape-attaching device 7 to the arm assembly 3, each separately from another but in movable states as required by their functions, even though, the three devices are all housed within the same housing case 4*a* of the main preparing device 4 in the FIG. 4 example described herein.

Figure 5B:
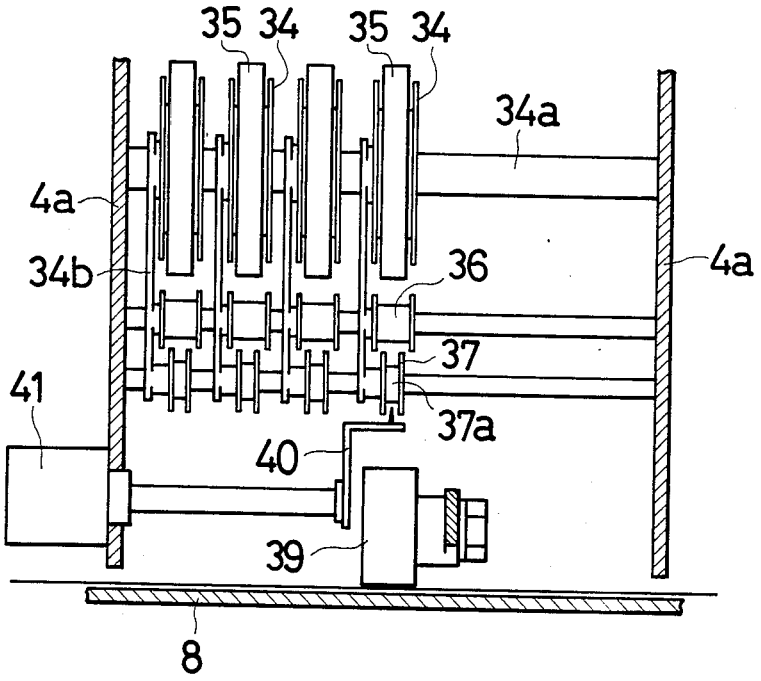
FIG. 5B is a schematic elevational view of an alternative embodiment of the device shown in FIG. 5A.

Relating to the adhesive tape-attaching device 7 which is a mechanism with only one reel 34 in the example described herein, the present invention can also be practiced with an alternative embodiment which, as shown in FIG. 5B, consists of two or more combinations of a tape reel 34, a guide roller 36 and a V-grooved roller 37, each combination having a connecting means 34*b* for holding the tape reel, guide roller and V-grooved roller in a uniform set and supported on a shaft 34*a* in such a manner as to be rotatable and movable in the axial direction so that with such an alternative mechanism double side-coated adhesive tape can be replaced with a spare reel by shifting the combinations in the axial direction.

Figure 6:
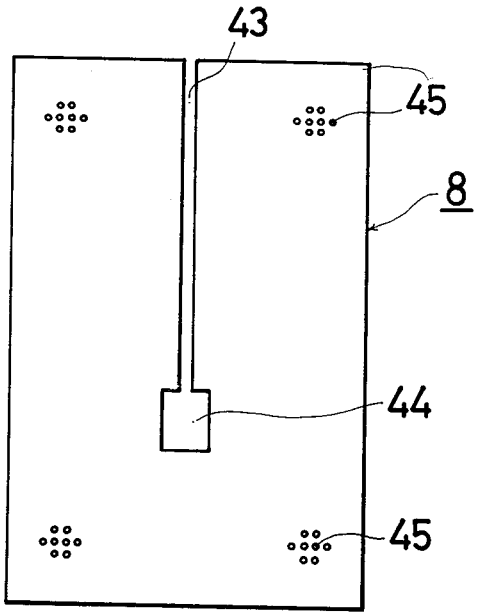
FIG. 6 is a schematic top view of the table board of the FIG. 1 integrated device.

The table board 8 measures somewhat larger in breadth than a paper roll 1 and is supported in a fixed position by the base frame 14. As shown in FIG. 6, the table board 8 has an opening 44 for attaching a web edge fastening strip in place to a web end from under and a lengthwise opening 43, which is a little wider in breadth than the web edge fastening grip. The table board 8 has groups of small holes 45 pierced therethrough at suitable places and is equipped with a pump-operated vacuum device (not shown in diagrams) which, by suction through the small holes from under, holds a web end firmly in place on the table board 8.

Figure 7:
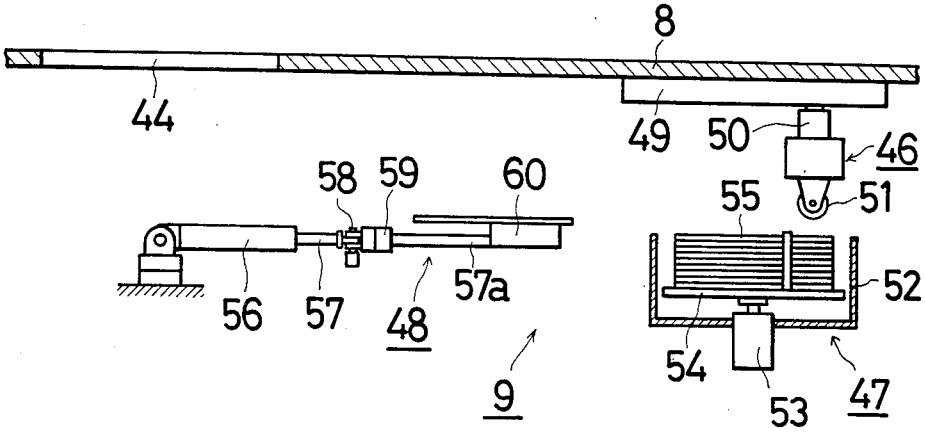
FIG. 7 is a schematic front view of a web edge fastening strip-attaching device of the FIG. 1 integrated device.

The web edge-fastening strip-attaching device 9 is positioned under the table board 8, as shown in FIG. 7, and comprises an adhesive dispenser 46, a fastening strip-loading bed 47, and a vacuum suction cup type holder 48 in rod form.

The adhesive dispenser 46 is held in such a manner as to be movable along a guide rail 49, i.e., in directions perpendicular to the axis of a paper roll, as well as in vertical directions by means of a solenoid 50, and is designed to apply an adhesive to a web edge fastening strip by gliding a roller 51 in contact with and along the upper face of a fastening strip 55 in the lengthwise direction of the guide rail 49. The fastening strip-loaded bed 47 comprises a housing framework 52, a loading bed-plate 54, and a cylinder 53 which lifts up and lowers the loading bed-plate 54. On the loading bed-plate 54 are laid a plurality of rectangular fastening strips 55 one over another. The vacuum suction cup type holder 48 comprises a cylinder 56, a piston rod 57, universal couplings 58 and 59, and a vacuum suction cup 60. The cylinder 56, having a rotative device at the base end, is capable of being moved in the horizontal directions. The piston rod 57 is designed to be moved out of and into the cylinder reciprocally. The universal coupling 58 is designed to be pivotally bent 90 degrees. Furthermore, the foremost arm 57*a* of the rod, holding the suction cup 60, is designed to be circumferentially turned 180 degrees by means of the universal coupling 59.

The paper roll-pressing device 10 consists of a roller which is vertically movable, as shown in Fig. 1, and is designed to apply pressure peripherally on the paper roll 1 when the roll's web end is drawn forward, apart from the periphery, and is then drawn back by a reverse turn of the paper roll 1. This allows the web end to be drawn back in position on the paper roll 1 without causing slack.

Referring to the device embodying the present invention in the foregoing descriptions, a process applicable to paper roll preparation for web pasting is now described hereunder.

(1) First a paper roll is rotatably loaded on the paper roll stand 2, as shown in FIG. 1.

Figure 8A:
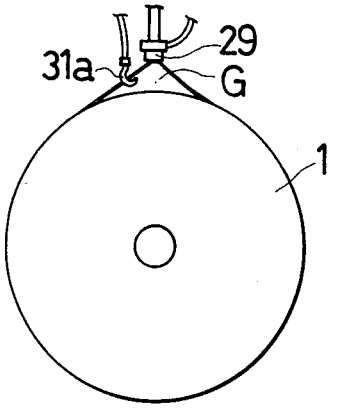
FIG. 8A is a side view of a suction cup device lifting a layer of a paper roll in preparation for being cut by a blade, in operation of the integrated device of FIG. 1.

(2) Next, as shown in FIG. 8A, the vacuum suction cup device 5 is activated to lift up the outermost web of the paper roll with the suction cup 29. The blade 31*a* of the cutter 31 constituting a part of the cutter unit 6 is then inserted into the opening G produced by the suction cup's lifting. By moving the main preparing device 4 breadthwise the outermost web is thusly cut across.

Figure 8B:
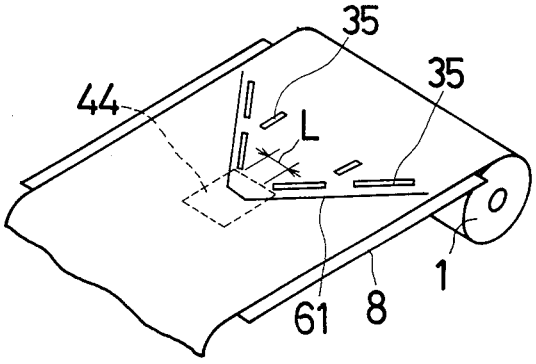
FIGS. 8B and 8C are isometric views of a paper roll and a table board of the integrated device of FIG. 1 depicting the manner in which tape and fastening strips are adhered to the leading web end of the roll in preparation for pasting.

(3) When the peripheral web has been thus cut, the leading web end is brought onto the table board 8 by turning the paper roll 1 forward, as shown in FIG. 8B.

(4) When the web edge is at the table board 8 as described above, the adhesive tape-attaching device 7 housed in the main preparing device 4 is activated to adhesively attach strips of double side-coated adhesive tape 35 for web splicing to the outer side of the web end at positions in sequence according to a set arrangement, as shown in FIG. 8B.

Simultaneously with the above-described attachment of double side-coated adhesive tapes, an incision substantially in the shape of an angle of a triangle is formed in the web end by the use of the cutter 32 of the cutter device 6.

The lengthwise space in the middle indicated by L in FIG. 8B is set apart as a path for the drive belt D by means of which the paper roll is rotated for splicing to an expiring web.

Figure 8C:
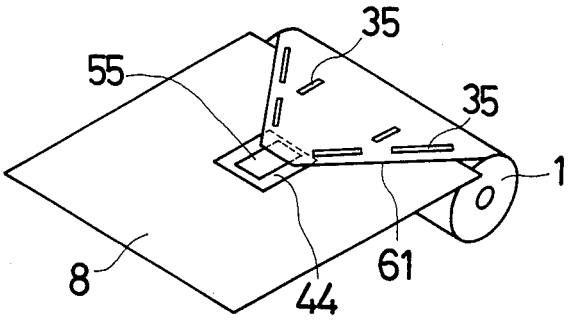

(5) During the time when the main preparing device 4 prepares the leading web end as described above, the web edge fastening strip-attaching device 9 positioned under the table assembly 8 adhesively attaches a fastening strip 55 to the inner side of the V-shaped web edge in the middle, as shown in FIG. 8C.

(6) When the web edge fastening strip 55 has been attached in place, the web end is drawn back by a backward turn of the paper roll 1. During this retraction the free pressing roller 39 is made to apply pressure on the web end so that a cutaway, foremost, portion of the web end is separated from the paper roll 1 at an incision 61. The newly formed web edge is drawn back on the paper roll 1 by continued backward turns of the paper roll and the paper roll-pressing device 10 is made to apply pressure peripherally on the paper roll.

Figure 10:
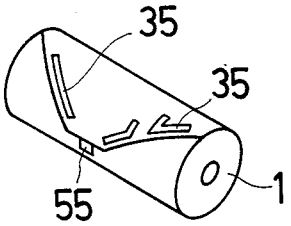
FIG. 10 is a schematic perspective view of a paper roll prepared for web splicing according to principles of this invention.
Figure 11:
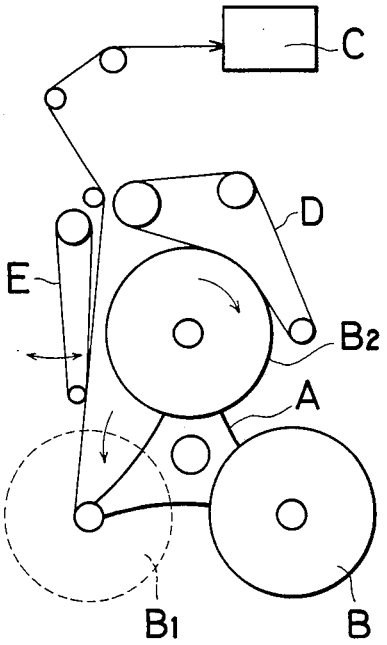
FIG. 11 illustrates schematically the manner in which a new paper roll is spliced to an expiring web; and, FIG. 12 is a schematic perspective view of a paper roll manually prepared for web pasting.
Figure 12:
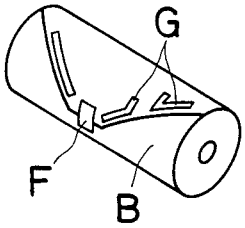

The paper roll-pressing device 10 applies pressure peripherally on the paper roll 1 when the paper roll is turned backward so that the tail of the fastening strip 55 is fixed to a position adjacent to the foremost web edge on the paper roll 1 with a double-side coated adhesive tape 62*a* therebetween. FIG. 10 schematically shows a paper roll with the web edge fastened in position in the manner described above.

With respect to formation of the incision 61, attachment of the double side-coated adhesive tapes 35, and separation of the foremost web end at the incision 61, of which the descriptions appear under (3) and (4) above, the process permits these steps to be carried out in any suitable order.

When the cutter device 6 or the adhesive tape-attaching device 7 is operating, a vacuum suction device for the table board 8 operates so as to hold the web end fast to the table board with suction.

The adhesive tape-attaching device 7 operates in the following manner.

A solenoid 28, as an operating device for the main preparing device 4, is activated to lower the housing case 4*a* at its forward part, so that the free pressing roller 39 is lowered enough to press against the paper web on the table board 8. The electric motor 41 is then rotated to turn a rotaton supporting pin 40 in a circular motion. By this turning of the rotation supporting pin 40 the double side-coated adhesive tape 35, drawn by a pin point 40*b* attached to the tip of the rotation supporting pin 40, is brought onto the outer surface of the web end and adhesively attached thereto under pressure from the free pressing roller 39.

When the leading end of the adhesive tape 35 has been adhesively attached to the web end, the housing case 4*a* glides along the web end in a set direction, the gliding causing the adhesive tape 35 to be paid out and adhesively attached to the web end proportionately.

When the leading end of the adhesive tape 35 has been adhesively attached to the web end, the rotating supporting pin 40 is pulled out of the adhesive tape by a scraper 42 and then stops turning for a time until the next cycle. When a given length of the adhesve tape 35 has been adhesively attached in position, the rotating supporting pin 42 resumes the turning and is stuck into the adhesive tape 35 at the V-grooved roller 37. A tape cutter 38 is then activated to cut the adhesive tape 35 and the housing case 42 is glided to such an extent as to make the posterior end of the adhesive tape adhesively attach to the web end.

The protective-coating-film remover 33 is activated where necessary to remove the protective coating film overlying the strips of the adhesive tape 35 adhesively attached to the leading web end so that the adhesive coating of the splicing strips is exposed.

Figure 9A:
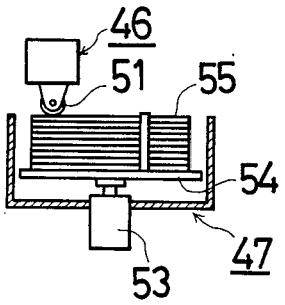
FIG. 9 is a schematic side view illustrating the procedure wherein a web edge fastening strip is applied to a web in use of the integrated device of FIG. 1.
Figure 9B:
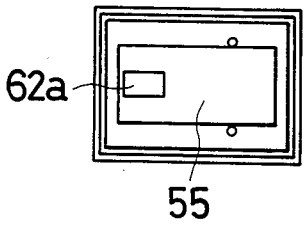
Figure 9C:
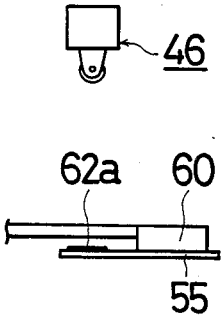
Figure 9D:
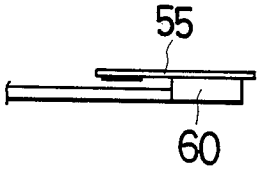
Figure 9E:
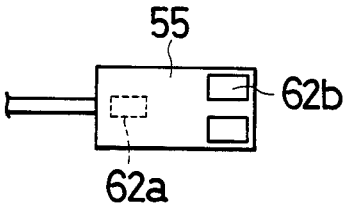
Figure 9G:
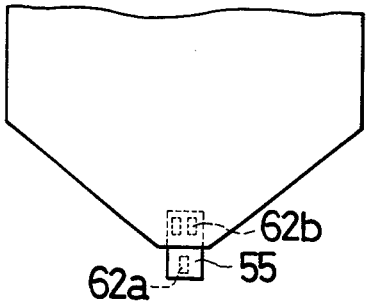
Figure 9F:
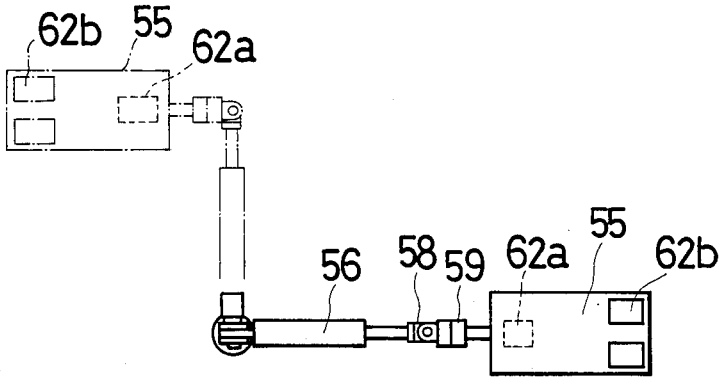

The web edge fastening strip-attaching device 9, positioned under the table board 8, is designed to be operated as follows:

(1) the cylinder 53 of the fastening strip-loading 47 is activated to push up the loading bed-plate 54 (FIG. 9A);

(2) the solenoid 50 of the adhesive dispenser 46 is activated so the roller 51 contacts a web edge-fastening strip 55;

(3) the adhesive dispenser 46 is moved across the fastening strip 55 simultaneously with action of the dispenser roller 51 to draw out strips 62*b* of adhesive tape and attach them adhesively to the head surface of the fastening strip 55 (FIG. 9B);

(4) the fastening strip-holder 48 is activated to pick up a fastening strip 55 by means of the vacuum suction cup 60 (FIG. 9C);

(5) the foremost arm 57*a* of the holder 48 in rod form is then circumferentially turned 180 degrees so the suction cup 60 holds the fastening strip 55 upside down (FIG. 9D);

(6) the adhesive dispenser 46 is activated again to attach a strip 62*a* of adhesive tape adhesively to the upper tail surface of the fastening strip 55 (FIG. 9C);

(7) next, the cylinder 56 is made to assume a vertical position and the holder 48 is pivotally bent at the universal couplings 58 and 59 so that the suction cup 60 is made again to assume a horizontal position;

(8) finally, the holder 48 is extended to bring the foremost arm 57*a* to a position suitable for passing the suction cup 60 through the opening 44 in the table board 8 upward so as to attach the head of the web edge fastening strip 55 adhesively to the inner side of the web edge at the pointed end which then has a shape of substantially an angle of a triangle (Fig. 9F and 9G).

Whereas the description herein relating to the web edge fastening strip-attaching device 9 refers to an adhesive dispenser 46 for strips of adhesive tape 62, it is also practical in the practice of the present invention to employ an adhesive dispenser which is designed to apply a liquid adhesive with the roller 51 as the coating means or to employ a method wherein the fastening strips 55 have pieces of adhesive tape 62*a* and 62*b* in place beforehand and, each of these adhesive tape pieces 62*a* and 62*b* is overlaid with protective coating film. The fastening strips 55 would then be attached to web edges after removing the protective coating film.

After the completion of shaping the web end edge in a V-shape, the adhesive attachment of double side-coated adhesive tape 35, and the adhesive attachment of a web edge fastening strip 55 the paper roll 1 is turned backward to draw back the web end onto the paper roll 1 with the paper roll-pressing device 10 applying pressure peripherally on the paper roll 1 during this reverse turn. Since the table board 8 has a lengthwise opening 43 for passage of web edge fastening strips 55 in the middle and air is blown upward from under through the lengthwise opening 43, the web edge fastening strip 55 with adhesive 62*a* exposed at the tail does not get stuck on the table board 8 when the web end is drawn back. By this reverse turn of the paper roll 1 the web edge fastening strip 55 is adhesively attached to the peripheral web of the paper roll 1 by means of the adhesive 62*a* at the tail and under pressure from the paper roll-pressing device 10. The paper roll 1 is thus prepared for web pasting with its web end finished as shown in FIG. 10.

Each of the devices referred to in the foregoing descriptions is operated fully automatically with the control device 11 giving instructions with signals according to a predetermined program.

What is claimed is:

1. A device in a printing system for preparing paper rolls held on a reel stand for web pasting which comprises:

a paper roll stand for holding a paper roll in such a manner as to hold it rotatable in two opposite directions;

a table board for supporting thereon the leading web end of a paper roll;

an arm assembly positioned above said table board, whose arm proper is movable to move its foremost end in lateral directions as well as in lengthwise directions;

a vacuum suction cup device held by said arm assembly for lifting up the outermost web of the paper roll;

a cutter device held by said arm assembly for cutting the web of the paper roll;

an adhesive tape-attaching device held by said arm assembly for adhesively attaching adhesive tapes for web pasting to the leading web end of the paper roll;

a web edge-fastening strip-attaching device for adhesively attaching one end portion of a fastening strip to the inner side of the leading web end of the paper roll; and, a paper roll-pressing device for adhesively attaching the other end portion of said web edge fastening strip to the outer surface of the paper roll.

2. A device as claimed in claim 1, wherein said vacuum suction cup device, said cutter device and said adhesive tape-attaching device are held by said arm assembly in such a manner as to be movable.

3. A device as claimed in claim 1, wherein said cutter device comprises a cutter for cutting the peripheral web of a paper roll breadthwise and a cutter for cutting the web end into an appropriate shape.

4. A device as claimed in claim 1, wherein said web edge fastening strip-attaching device includes an adhesive dispenser for applying adhesives to web edge fastening strips.

5. A device as claimed in claim 1, wherein said table board is equipped with a vacuum suction device.

6. A device as claimed in claim 1, wherein said adhesive tape-attaching device includes a spare adhesive tape feeding device.

7. A device as claimed in claim 1, wherein said paper roll stand is an essentially three-sided structure erected on a floor of a building.

* * * * *